United States Patent [19]

Thorogood et al.

[11] 4,387,015

[45] Jun. 7, 1983

[54] COAL LIQUEFACTION QUENCHING PROCESS

[75] Inventors: Robert M. Thorogood, Macungie; Chung-Liang Yeh, Bethlehem, both of Pa.; Ernest E. Donath, St. Croix, V.I.

[73] Assignee: International Coal Refining Company, Allentown, Pa.

[21] Appl. No.: 431,511

[22] Filed: Sep. 30, 1982

[51] Int. Cl.[3] ..... C10G 1/00; C10G 1/06

[52] U.S. Cl. ..... 208/8 LE; 208/10; 208/48 Q

[58] Field of Search ..... 208/8 LE, 48 Q, 10

[56] References Cited

U.S. PATENT DOCUMENTS 2,928,886 3/1960 Nisbet et al. ..... 208/48 Q 3,429,942 2/1969 Nelson et al. ..... 208/48 Q 4,150,716 4/1979 Ozaki et al. ..... 208/48 Q 4,216,074 8/1980 Simone ..... 208/10

*Primary Examiner*—Delbert E. Gantz

*Assistant Examiner*—Lance Johnson

*Attorney, Agent, or Firm*—Mark F. Wachter

[57] ABSTRACT

There is described an improved coal liquefaction quenching process which prevents the formation of coke with a minimum reduction of thermal efficiency of the coal liquefaction process. In the process, the rapid cooling of the liquid/solid products of the coal liquefaction reaction is performed without the cooling of the associated vapor stream to thereby prevent formation of coke and the occurrence of retrograde reactions. The rapid cooling is achieved by recycling a subcooled portion of the liquid/solid mixture to the lower section of a phase separator that separates the vapor from the liquid/solid products leaving the coal reactor.

9 Claims, 1 Drawing Figure

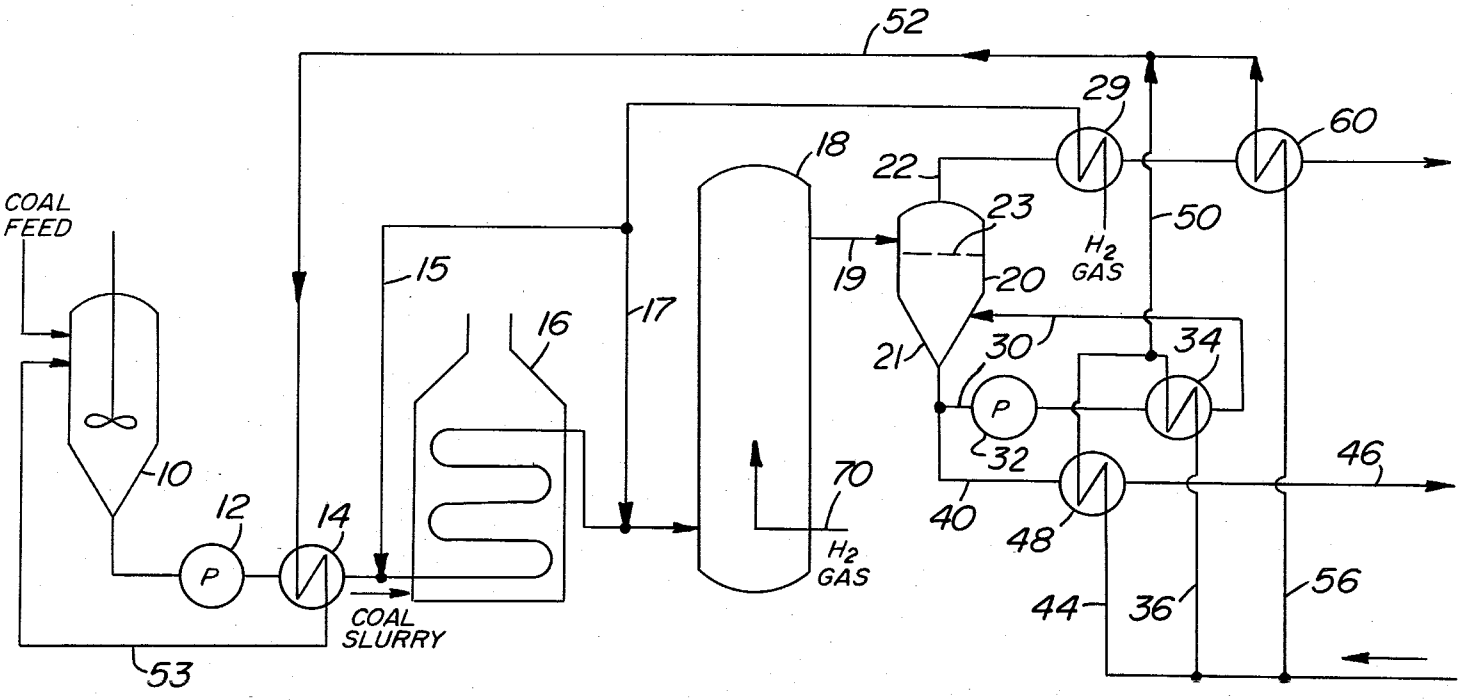
COAL FEED
COAL SLURRY
$H_2$ GAS
$H_2$ GAS
P
P
10
12
14
15
16
17
18
19
20
21
22
23
29
30
32
34
36
40
44
46
48
50
52
53
56
60
70

COAL LIQUEFACTION QUENCHING PROCESS

The Government of the United States of America has rights in this invention pursuant to Contract No. DE-ACO5-78ORO3054 (as modified) awarded by the U.S. Department of Energy.

BACKGROUND OF THE INVENTION

This invention relates to a process for the solvent refining of coal wherein coal is liquefied by subjecting it to a hydrogen donor solvent (hereinafter referred to as "solvent") in the presence of a hydrogen-rich gas at elevated temperatures and pressures to produce solid and liquid products. This process is referred to in the art as SRC-I, solvent refined coal having the acronym "SRC".

In this process, following solvation, the products are separated into gaseous material, distillate fractions and vacuum distillation bottoms. The vacuum distillation bottoms, which contain entrained mineral matter and unconverted coal macerals, are separated in a deashing step. From the solids removal step there is recovered a stream of coal products which are free of ash minerals and unconverted coal and which are essentially low in sulfur content, such that this material is ideally suited for combustion in environmentally acceptable operations.

The SRC-I pilot plants at Wilsonville, Ala. and Fort Lewis, Wash. have been operated with a coal liquefaction reactor (also known as the dissolver) preceded by a preheater. The coal liquefaction reactions take place to some extent in both these vessels. A slurry of coal in recycled solvent under hydrogen pressure is passed through the preheater where its temperature is raised from ambient to a temperature in excess of 750° F. The heated slurry is passed to the reactor whereat the reaction of the hydrogen gas, the coal and the solvent take place at temperatures in excess of 780° F. and pressures in excess of 1,000 psia, the liquefaction reactions including desulfurization, solvent production, solvent rehydrogenation, etc.

So long as hydrogen gas is present, the forward rate of reaction to produce asphaltenes an oils from dissolved coal is greater than the retrograde repolymerizations which lead to the formation of coke and preasphaltenes from the lower molecular products. However, at the exit of the reactor it is necessary to separate the gas phase containing hydrogen from the slurry phase containing the soluble coal products and solid residues. This separation is carried out as a first stage in the separation of the reaction products. In the absence of hydrogen gas, it is known that coke formation may occur and preasphaltenes are formed by repolyerization. These undesirable reactions are increased by increased temperature and residence time.

The problem of coke formation in the reactor effluent separator when operating at or close to reactor temperature has been observed at the Wilsonville pilot plant. At Wilsonville, coke formation in the outlet separator was observed when operating at 800° F. while previous operation at temperatures below 780° F. did not encounter this problem.

One method which has been used to prevent retrograde reactions is to directly cool the total coal reactor effluent either by heat exhange or by quenching. These procedures have been used in the pilot plant operations at Wilsonville and Fort Lewis. More specifically, the coal liquefaction reactions occur at a temperature in the range of 800°–880° F. and the three phase effluent is cooled to a temperature generally below 780° F. sufficiently low to prevent coke formation prior to phase separation. In the design of the SRC-I Demonstration Plant the cooling of the effluent is effected using recycled solvent. Thus, the prior art method involves cooling the total reaction product stream leaving the reactor and is inherently inefficient.

SUMMARY OF THE INVENTION

It is the general object of the invention to provide a coal liquefaction quenching process which prevents the formation of coke with a minimum reduction of thermal efficiency of the coal liquefaction process. Briefly stated, the improved process of the invention comprises the rapid cooling of the liquid/solid products of the coal liquefaction reaction without cooling of the associated vapor stream to thereby prevent formation of coke and the occurrence of retrograde reactions. The rapid cooling is achieved by recycling a subcooled portion of the liquid/solid mixture to the lower section of a phase separator that separates the vapor from the liquid/solid products leaving the coal reactor. The recycled stream is introduced below the gas-liquid interface in the separator. Since the cooling action is achieved by direct mixing with a non-volatile cold liquid recycle quench stream there is no vaporization and bubbling action which would cause displacement of the cooled stream into the hot vapor, thereby avoiding undesirable cooling of the vapor.

In accordance with the process of the invention, heat is recovered separately from the vapor phase of the reaction products such as by a process stream which may be reheated close to reaction temperature and recirculated directly to the reaction system. Heat recovery may thus be obtained at the highest possible temperature without the difficulties inherent in the cooling of a three-phase mixture in a heat exchanger (as is the case in the prior art). Also, the heat recovery is achieved with a higher thermal efficiency than may be obtained in the prior art total quench of the reaction products.

BRIEF DESCRIPTION OF THE DRAWING

The single FIGURE in the drawing shows a schematic flow diagram of the preferred embodiment of the invention.

DETAILED DESCRIPTION OF THE PREFERRED EMBODIMENT

Feed coal, typically finely crushed bituminous coal, is mixed with recycle solvent in a slurry mix tank 10 in a ratio from 1:1.2–1:3. The slurry from tank 10 is passed to a pumping unit 12 that pumps the slurry up to a pressure in the range of 1,000–3,000 psia. The pressurized slurry is heated to an intermediate temperature in the range of 400°–500° F. by a heat exchanger 14 wherein a heated recycle solvent is passed in heat exchange relationship with the slurry. The heated slurry is combined with a first portion of a hydrogen gas stream via line 15. The three-phase gas/slurry stream is then introduced into a preheater system comprised of an externally heated tubular reactor 16. The temperature of the three-phase mixture is heated to the reaction temperature in the preheater. The second portion of a hydrogen gas stream is added to the preheated slurry via line 17 and the mixture is passed to a coal liquefaction stage wherein the slurry is delivered to a coal reactor 18. The reactor 18 comprises one or more tubular vessels operated in an adiabatic mode without the addition of significant external heat. In the reactor 18 the coal liquefaction reactions take place at a temperature in the range of 800°–880° F. The temperature distribution in the reactors is controlled by the intermediate injection via line 70 of cold recycle hydrogen gas, ranging in temperature from 150° to 250° F. in the lower portion of the reactor.

In accordance with the process of the invention, the effluent from the reactor 18 is passed directly therefrom via line 19 to a gas/slurry phase separator 20 without being cooled. The gas phase is withdrawn from the separator 20 via line 22 and is used to heat hydrogen gas passing through a heat exchanger 29 to lines 15 and 17 for recycling to the process as shown in the drawing.

The separator 20 is a cylindrical vessel have a lower conical portion 21. The system is designed so that the inlet to the separator 20 is above the slurry level therein, indicated at 23.

In accordance with the process of the invention, the hot slurry entering the separator 20 at a temperature ranging from about 800° to 880° F. is cooled by a recycled slurry stream ranging in temperature from about 540° to 700° F. and preferably about 600° F. to a sufficiently low temperature (below about 780° F.) to suppress coke formation. Also, the residence time of the slurry at high temperature in the absence of hydrogen is minimized by the immediate mixing with the coal recycle slurry stream. To this end, effluent slurry passing from the bottom end of portion 21 of separator 20 is divided into two streams. One stream passes via a loop 30 through a pump 32 which delivers the stream to a heat exchanger 34 wherein the stream is cooled by passing in heat exchange relationship with cold recycle solvent flowing through line 36 as is shown in the Drawing. For purposes of this invention, reference to such a "cold recycle solvent" means a recycle solvent stream which is not heated but remains at or about the temperature, ranging between about 350° to 450° F., at which it leaves separation system after distillation. The slurry passses from heat exchanger 34 back to portion 21 of separator 20, having been cooled at heat exchanger 34 by the recycle process solvent. The recycle process solvent would correspondingly be heated to a temperature of 700°–750° F. in heat exchanger 34 for use in preheating the reactor feed slurry. The temperature and flow of the recycling slurry stream are chosen such that sufficient flow is available for effective mixing with the hot slurry in separator 20. The preferred operating conditions for the slurry quench recycling are at flows from 25 to 75% of the normal slurry flow from separator 20, with the slurry quench flow cooled correspondingly to 540°–700° F.

The second part of the effluent slurry from separator 20 is passed via line 40 to a heat exchanger 48 wherein it is cooled against cold recycle process solvent flowing through line 44 to a temperature typically about 750° F. suitable to allow pressure reduction in a subsequent vapor separation and distillation system without the need for reheating, the cooled slurry being fed to such system via line 46.

The heated recycle solvent streams passing through heat exchangers 34 and 48 are combined and pass via line 50 to a line 52 which delivers the solvent to heat exchanger 14 from which it is fed to tank 10 via line 53. The gas phase passing from heat exchanger 29 also passes through heat exchanger 60 for raising the temperature of the cold recycle process solvent passing from line 56 to line 52.

As was discussed above, in accordance with a typical prior art process the effluent from the reactor is passed directly to a heat exchanger for cooling the same prior to passage to a three-phase separator. It will be apparent that the process of the invention has several important advantages over this prior art method. The first advantage of the process of the invention is the avoidance of coke formation by minimization of the residence time at high temperatures in the absence of hydrogen. Secondly, an important advantage of the process of the invention is the maximization of the temperatures at which the heat can be recovered from the reactor effluent without coke formation. A third advantage is the avoidance of the difficulties attendent in the cooling of a three-phase effluent stream of the type leaving the reactor.

It is well appreciated that the above description is schematic and recites the essential operation of the process and that those skilled in the art will know where to supply and how to employ the necesary valves, pumps, pressure equipment and other standard engineering elements required in the system.

The invention will now be described by reference to a specific example, although it is to be understood that this example is illustrative only and not intended to be limitative.

EXAMPLE

The process description refers to the drawing of FIG. 1.

For the production of solvent refined coal (SRC) by the SRC-I process, 5600 T/D (i.e. Ton/Day) of bituminous coal is ground to a particle size below 200 mesh. This material is slurried by mixing with 9000 T/D of recycled aromatic process solvent having an atmospheric boiling range of 400° to 900° F. The slurry is prepared in one or more agitated vessels at a pressure slightly above atmospheric and at a temperature of 400° F.

The slurry is divided into six parallel streams and pumped by a combination of centrifugal and reciprocating pumps to a pressure of 2900 psig, whereafter, it is heated in a series of heat exchangers to a temperature of 500° F.

Hot recycle hydrogen gas at a temperature of 800° F. is mixed at a rate of 135 T/D with the slurry to generate a three phase mixture of coal-oil-gas before entering preheat furnace in which the mixture is heated to a temperature of 760° F. In the preheat furnace the dissolution of the coal and the reactions to produce SRC, aromatic oils and residue materials are commenced.

The preheated three phase mixture is mixed with a further 135 T/D of hot recycle hydrogen gas before entering the first of two coal liquefaction reactors. In these reactors the coal liquefaction process is complete at a temperature of 840° F. and a pressure of 2600 psig to produce SRC, aromatic oils, residual ash, undissolved coal, and gaseous products of reaction. The temperature distribution in the reactors is controlled by the intermediate injection of a further 135 T/D of cold recycle hydrogen gas into the lower portion of the reactor.

The effluent three phase steam from the reactors is passed directly at a temperature of 840° F. to a separator in which the gaseous phase is separated from the slurry phase. The slurry phase at 840° F. and with a flow of 12000 T/D is mixed below the gas-liquid surface in the separator with a recycle slurry flow of 6000 T/D at a temperature of 600° F., to obtain a mixed slurry stream leaving the separator at a temperature just below 780° F. and at a pressure of about 2550 psig. The separated gas stream leaves overhead from the separator at a temperature close to 840° F.

The slurry stream leaving the separator is divided into a product stream and a recycle stream, with respective flows of 12000 T/D and 6000 T/D. The recycle stream is passed by a pump to a heat exchanger in which it is cooled from 780° F. to 600° F. by cold recycle process solvent (i.e. 400° F.). Thence the cooled recycle slurry is returned directly to below the liquid interface in the separator.

The product slurry stream from the separator is cooled to 750° F. in a heat exchanger against another portion of cold recycle process solvent before being further processed by phase separation and distillation to recovery the SRC and aromatic oil products, recycle solvent and residual solids.

The overhead hydrogen, gaseous products of reaction and vaporized oils streams with a total flow of 3600 T/D are passed through two heat exchange systems in series in which the gas is cooled to condense the light oil and aqueous components of the mixture. Cooling is effected in a heat exchanger by recycled hydrogen gas which is preheated to 800° F. before reinjection into the coal slurry ahead of the reactors. Further cooling of the gases is effected by cold recycle process solvent in yet another heat exchanger.

We claim:

1. In a process for the solvent refining of coal wherein a slurry of finely ground coal in process solvent is passed through a preheater to a coal liquefaction reactor in the presence of hydrogen rich gases at elevated temperatures and pressures, the improvement comprising passing effluent from the reactor directly to a gas/-slurry phase separator, and recycling slurry from said separator through a cooling heat exchanger and back to the slurry phase in said separator for cooling the same to suppress coke formation.

2. A process according to claim 1 wherein the gas phase in said separator is withdrawn therefrom and passed to a heat exchanger for heating a process stream.

3. A process according to claim 2 wherein said process stream is hydrogen gas being delivered to the process solvent being fed to said reactor.

4. A process according to claim 3 wherein said gas phase is passed from said first-named heat exchanger to a second heat exchanger whereat it is passed in heat exchange relationship with cold process solvent.

5. A process according to claim 1 wherein the effluent is passed from said reactor to said separator without cooling the same.

6. A process according to claim 1 wherein the recycle solvent is returned to said separator in an amount sufficient to cool the slurry phase of said separator to a temperature below about 780° F.

7. A process according to claim 1 wherein said recycle slurry is withdrawn from a bottom portion of said separator and pumped to a heat exchanger whereat cold recycle solvent is passed in heat exchange relationship therewith to cool the same for return to said separator at at temperature of about 540°–750° F.

8. A process according to claim 7 wherein the recycle solventis returned to said separator in an amount sufficient to cool the slurry phase of said separator to a temperature below about 780° F.

9. A process according to claim 7 wherein a portion of the recycle slurry withdrawn from the bottom of said separator is passed to a heat exchanger whereat it is passed in heat exchange relationship with cold process solvent.

* * * * *

UNITED STATES PATENT AND TRADEMARK OFFICE

CERTIFICATE OF CORRECTION

PATENT NO. : 4,387,015

DATED : 7 June 1983

INVENTOR(S) : R. M. Thorogood, C. L. Yeh, E. E. Donath

It is certified that error appears in the above-identified patent and that said Letters Patent are hereby corrected as shown below:

Col. 1, line 44 - Delete the word "an" and insert in its place -- and --.

Col. 1, line 54 - Delete the word "repolyerization" and insert in its place -- repolymerization --.

Col 6, line 30 - Delete the word "solventis" and insert in its place -- solvent is --.

Signed and Sealed this

*Eighteenth* Day of *October 1983*

[SEAL]

*Attest:*

GERALD J. MOSSINGHOFF

*Attesting Officer*

*Commissioner of Patents and Trademarks*